US008621832B2

(12) United States Patent
Bretthauer

(10) Patent No.: US 8,621,832 B2
(45) Date of Patent: Jan. 7, 2014

(54) DEVICE FOR PRODUCING SHRINK FILM-COVERED PACKS

(75) Inventor: Hans-J. Bretthauer, Bremen (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 49 days.

(21) Appl. No.: 12/097,014

(22) PCT Filed: Nov. 15, 2006

(86) PCT No.: PCT/EP2006/010929
§ 371 (c)(1),
(2), (4) Date: Jul. 31, 2008

(87) PCT Pub. No.: WO2007/068317
PCT Pub. Date: Jun. 21, 2007

(65) Prior Publication Data

US 2009/0145088 A1 Jun. 11, 2009

(30) Foreign Application Priority Data

Dec. 12, 2005 (DE) ..... 10 2005 059 620

(51) Int. Cl.
*B65B 53/02* (2006.01)

(52) U.S. Cl.
USPC ..... 53/557; 53/556

(58) Field of Classification Search
USPC ..... 53/557, 556, 376.7, 377.8, 148, 234, 53/466, 477
See application file for complete search history.

(56) References Cited

U.S. PATENT DOCUMENTS

| | | | | |
|---|---|---|---|---|
| 2,037,631 | A | 4/1936 | Hultin | |
| 3,166,462 | A * | 1/1965 | Schoder | 156/499 |
| 4,346,545 | A | 8/1982 | Crescenzo | |
| 4,408,439 | A * | 10/1983 | Anderson | 53/461 |
| 5,406,775 | A * | 4/1995 | Tacchi et al. | 53/466 |
| 5,477,661 | A | 12/1995 | Draghetti et al. | |
| 5,518,119 | A | 5/1996 | Takahashi | |
| 5,560,538 | A | 10/1996 | Sato | |
| 5,590,763 | A * | 1/1997 | Focke et al. | 206/271 |
| 5,613,344 | A * | 3/1997 | Osti et al. | 53/234 |
| 5,839,253 | A * | 11/1998 | Draghetti | 53/234 |
| 6,546,589 | B1 | 4/2003 | Job | |
| 7,200,978 | B1 | 4/2007 | Focke | |

FOREIGN PATENT DOCUMENTS

| | | | |
|---|---|---|---|
| DE | 3824924 | A1 | 1/1990 |
| DE | 199 57 415 | A1 | 5/2001 |
| DE | 699 00 221 | T2 | 2/2002 |
| EP | 0 731 023 | A2 | 9/1996 |

(Continued)

OTHER PUBLICATIONS

International Search Report.

(Continued)

*Primary Examiner* — Sameh H. Tawfik
(74) *Attorney, Agent, or Firm* — Laurence P. Colton; Smith Risley Tempel Santos LLC

(57) ABSTRACT

For the production of cigarette packs (10) with shrink-treated outer film, the packs (10) are subjected in a continuously rotating shrinking revolver (19) to a heat treatment effecting the shrinkage. To each pack (10) there are assigned, in the region of the shrinking revolver (19), heating plates (22, 23), which bear against the front side and rear side of the pack (10) or of the film.

9 Claims, 6 Drawing Sheets

(56) References Cited

FOREIGN PATENT DOCUMENTS

| | | | |
|---|---|---|---|
| EP | 0 605 838 | A1 | 7/1997 |
| EP | 0 970 889 | A1 | 7/1999 |
| EP | 1 055 603 | A | 11/2000 |
| EP | 1055603 | A1 | 11/2000 |
| EP | 1059236 | A1 | 12/2000 |
| EP | 1 084 954 | | 3/2001 |
| EP | 1 574 437 | A | 9/2005 |
| IT | 1246644 | | 4/1991 |
| JP | 10072011 | A | 3/1998 |

OTHER PUBLICATIONS

German Search Report.
Torta Research and Observations.
Notice of Opposition to a European Patent, European Patent Office, Regarding EP1960273, (Jan. 25, 2013).
D7.1 Innovia Films Tobacco Overwrap Range.
D7.2 Innovia Films Propafim SNC Data.
D7.3 Flex Flexopp B-TCO Technical Data Sheet.
D7.4 Flex Flexopp B-TCT Technical Data Sheet.
D7.5 Terichem Terfan AVT Technical Data Sheet.
D7.6 Jindal Polyfilms Limited Technical Data Sheet OPP Films.

* cited by examiner

*Fig. 4*
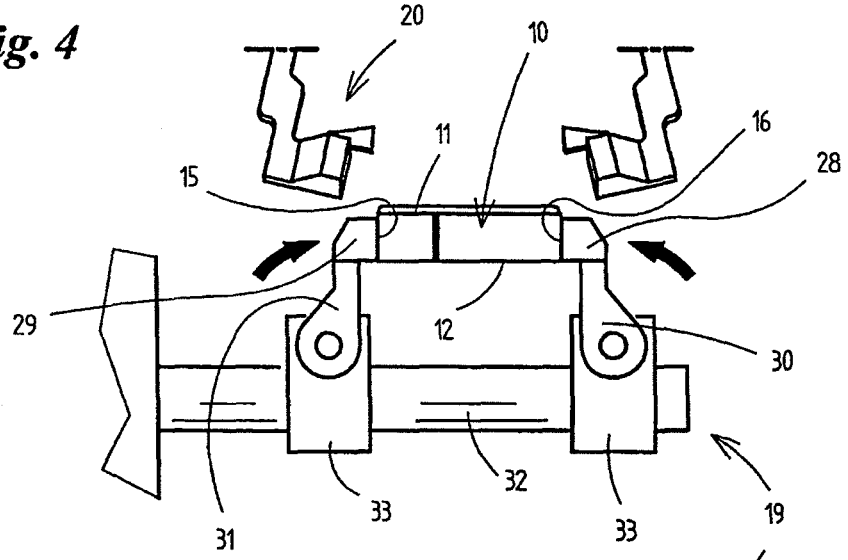
*Fig. 5*
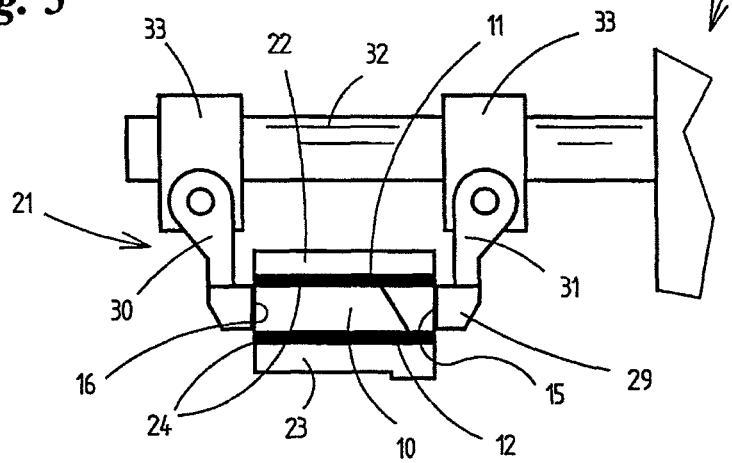
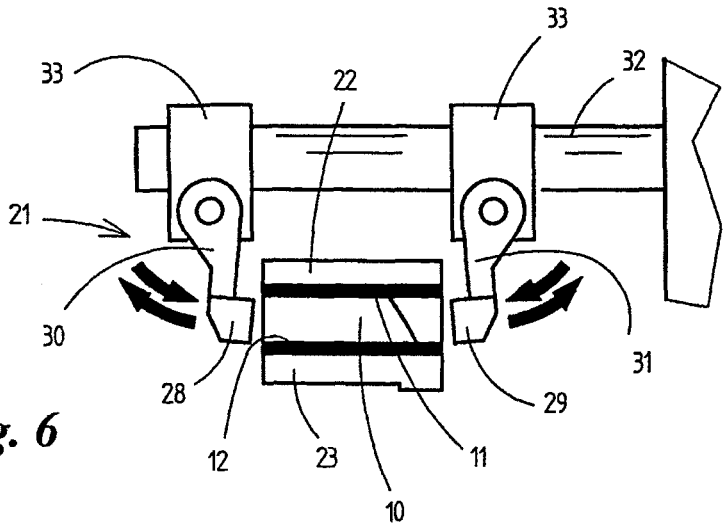
*Fig. 6*

DEVICE FOR PRODUCING SHRINK FILM-COVERED PACKS

STATEMENT OF RELATED APPLICATIONS

This application is the U.S. National Phase Under Chapter II of the Patent Cooperation Treaty (PCT) of PCT International Application No. PCT/EP2006/010929 having an International Filing Date of 15 Dec. 2006, which claims priority on German Patent Application No. 10 2005 059 620.7 having a filing date of 12 Dec. 2005.

BACKGROUND OF THE INVENTION

1. Technical Field

The invention relates to a device for producing (hard) packs having an outer wrapping of shrinkable film, in particular cuboid cigarette packs, to which packs heat can be supplied in the region of a shrinking unit.

2. Related Art

Packs, in particular hard packs for cigarettes, are increasingly provided with an outer wrapping of shrink film. The shrinkage effect is triggered by heat treatment, so that the outer foil enwraps the pack in a crease-free manner and under tension.

In a known device for producing shrink-film-covered cigarette packs, European Patent Application EP 1 084 954, the packs provided with the outer wrapping, following a sealing station for the heat sealing of folding tabs of the outer wrapping, are transported through a shrinking unit. This is provided with fixed plate-like heating members, which, during a stationary phase of the packs, come to bear against these in order to transfer the heat necessary for the shrinking process. The shrinking unit is limited in its output by the fixed-cycle operation.

BRIEF SUMMARY OF THE INVENTION

The object of the invention is to propose a device for producing shrink-film-covered packs, and a shrinking unit which ensures a higher output combined with an exact, controllable shrinking treatment of the packs.

For the achievement of this object, the device according to the invention is characterized by the following features:

a) the shrinking unit is configured as a continuously movable endless conveyor, namely a shrinking conveyor, b) the packs can be transported by the shrinking conveyor at a distance apart, c) to each pack there are assigned, in the region of the shrinking conveyor, at least two traveling heating members, which act on separate pack faces, for transferring heat to the packs during transport by the shrinking conveyor.

The shrinking conveyor is preferably a shrinking revolver, which is driven in a continuously rotating manner and has along the periphery a plurality of receptacles or pockets for a respective pack, to each receptacle there being assigned heating plates as heating members, which are movable relative to the packs and, during the actual shrinking process, bear against pack faces as the shrinking revolver rotates.

It is additionally of importance that each receptacle of the shrinking revolver has holding members for holding the pack during transport, which holding members can be moved independently of the heating plates and act on mutually opposing pack faces not acted upon by the heating plates.

The shrinking revolver according to the invention can be integrated into the production cycle of a continuous packing machine. The packs can be supplied by an upstream revolver, in particular by a sealing revolver. The transfer of the packs to the shrinking revolver is realized according to the invention with the aid of the holding members, which remove the packs one after another from a pocket or receptacle of the preceding revolver and introduce them into the receptacle or pocket of the shrinking revolver into a position between the heating plates.

BRIEF DESCRIPTION OF THE DRAWING FIGURES

Further features and peculiarities of the invention are set out below with reference to the drawings, in which:

FIG. 4 shows a transverse axial view of a detail in the region of the acceptance of a pack from a sealing revolver for transfer to the shrinking revolver.

FIG. 5 shows a detail of the shrinking revolver, namely a receptacle or pocket, in radial view according to the arrow V in FIG. 3.

FIG. 6 shows the detail of FIG. 5, the position of members having been altered.

DETAILED DESCRIPTION OF PREFERRED EMBODIMENTS

Figure 1:
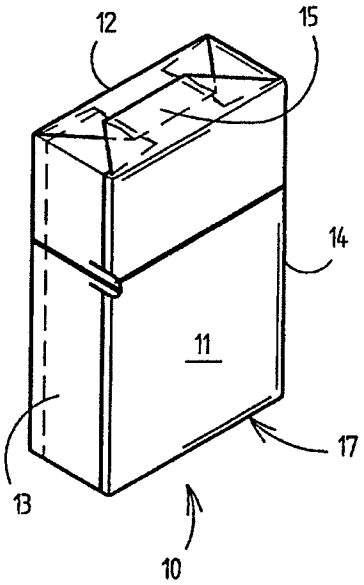
FIG. 1 shows a (cigarette) pack having shrinkable film as outer wrapping, in perspective representation.
Figure 2:
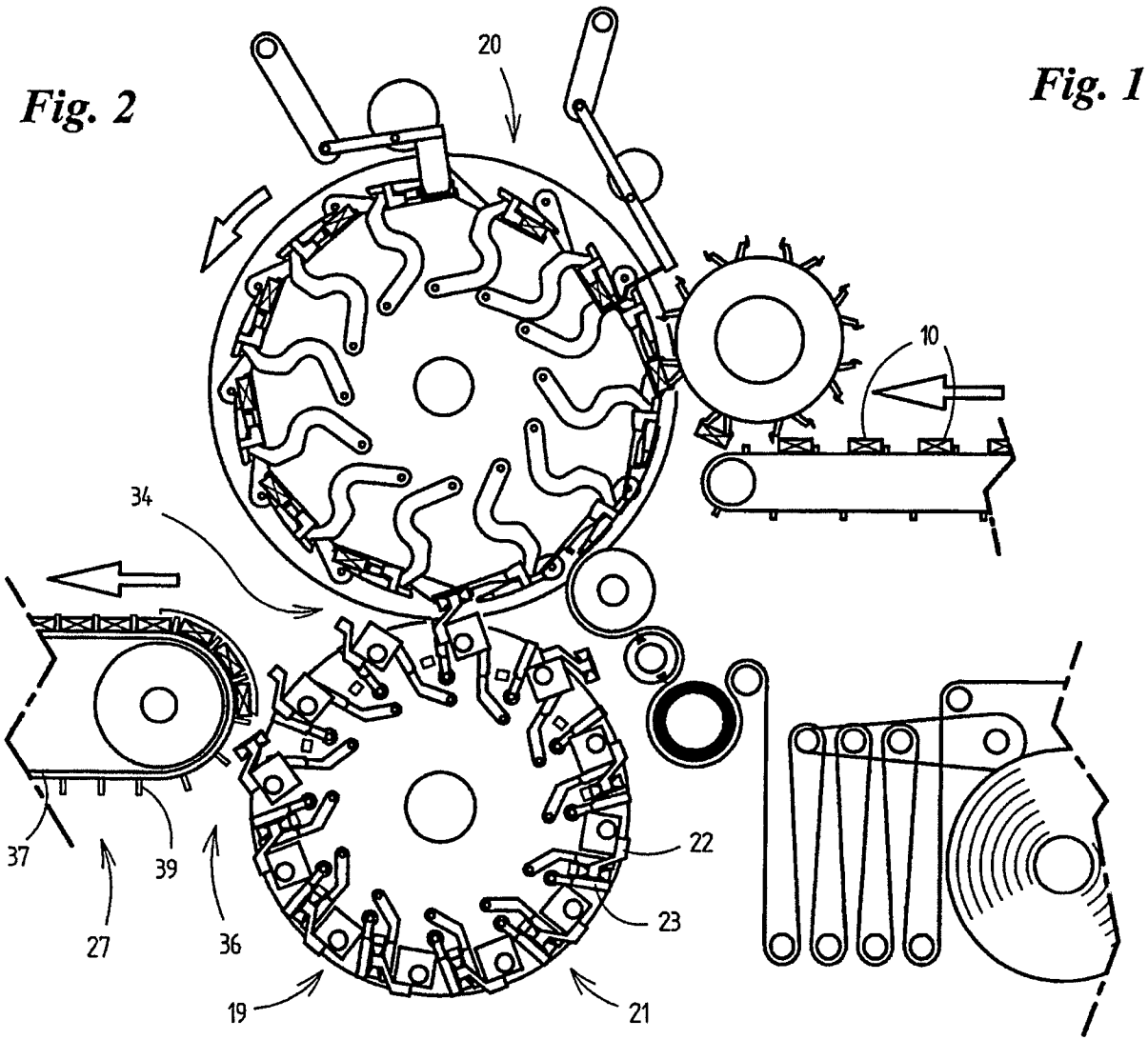
FIG. 2 shows a part-region of a continuously operating packing machine with shrinking revolver, in schematic side view.
Figure 3:
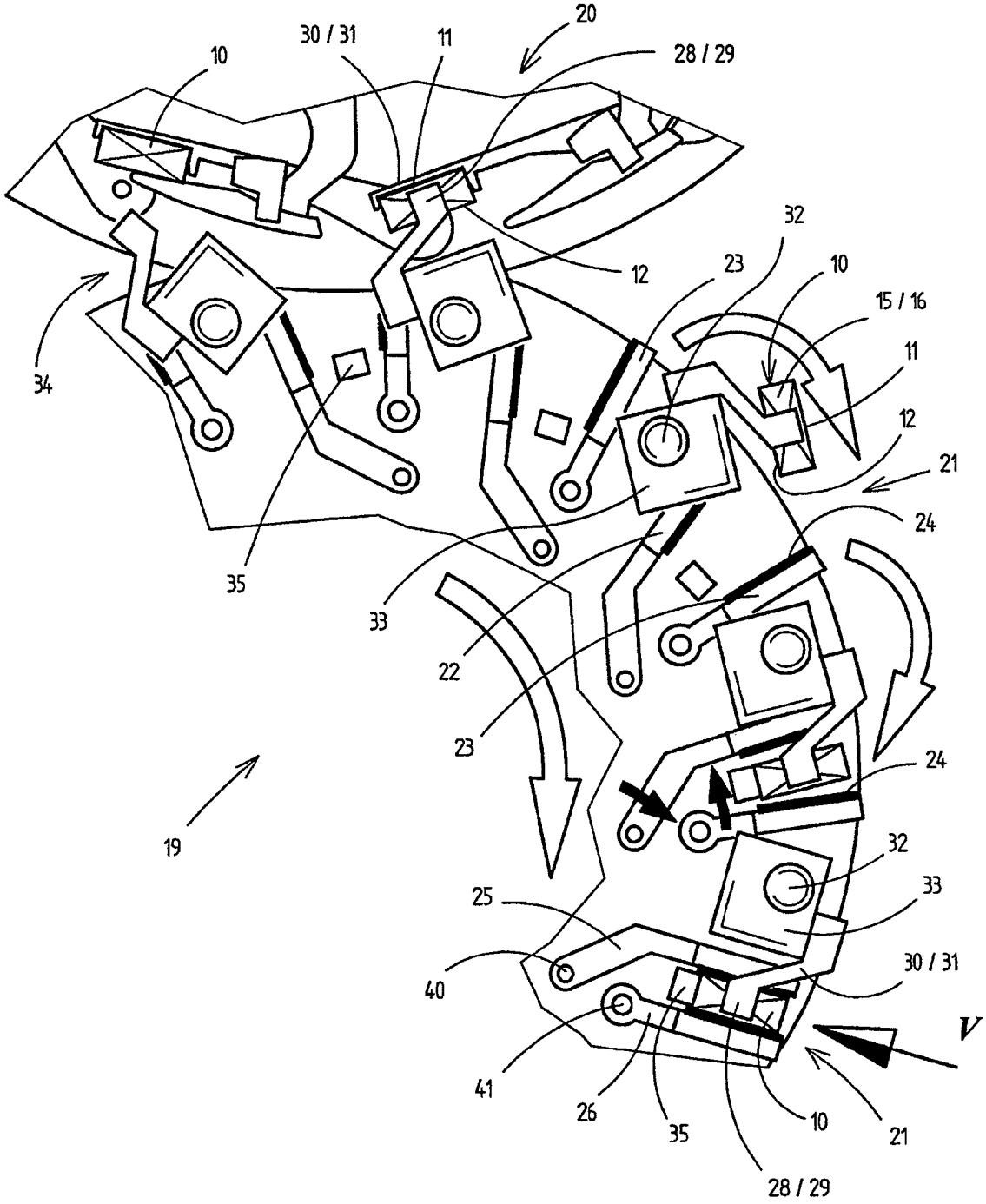
FIG. 3 shows a detail of the shrinking revolver in FIG. 2, on an enlarged scale.

The subject matter relates to the treatment of cuboid packs 10, to be precise, especially of cigarette packs of the folding carton type. The pack is here constituted by a folding carton, usually consisting of thin board, having pack faces or sides of different dimensions, namely with a large-area front side 11 and rear side 12, narrow side faces 13, 14, and end and bottom faces 15, 16.

The pack 10 is surrounded by an outer wrapping of film 17, which preferably bears against all pack faces. The film 17 has folds in the region of the end and bottom face 15, 16, as well as in the region of a side face 13. The folding flaps are joined together by heat sealing. The film 17 consists of heat-shrinkable material. For this purpose, the packs 10 provided with the outer wrapping, namely with the film 17, are fed to a shrinking unit, to be precise to a preferably continuously rotating shrinking revolver 19. The completely finished packs 10 are fed to the shrinking revolver 19 from a likewise preferably continuously driven conveyor, in particular from a sealing revolver 20 for heat sealing the folding flaps of the film 17. The shrinking revolver 19 is provided with a plurality of pockets or receptacles 21, distributed along the periphery, for a respective pack 10. The packs 10 are positioned in the receptacles 21 with their longitudinal extent in the axis-parallel direction. The large pack faces, namely the front side 11 and rear side 12, are approximately radially directed, at the front or back in the direction of conveyance, the side faces 13, 14, accordingly, being situated radially on the inside or outside.

In the region of a receptacle 21, the pack 10 is subjected to a heat treatment as it is transported by the shrinking revolver 19. Heat is hereupon transferred to the large-area packs sides, i.e. to the front side 11 and rear side 12. Heating members are configured as heating plates 22, 23. These bear with a preferably elastic heating pad 24 against the front side 11 and rear side 12. The heating plates 22, 23 are dimensioned such that the pack sides in question are fully covered. To each receptacle there are assigned two jointly, simultaneously movable heating plates 22, 23.

The heating plates 22, 23 are movable transversely to the packs 10 and to the pack sides 11, 12 to be acted upon. Each heating plate 22, 23 is attached to a swivel lever 25, 26. The kinematics for the heating plates 22, 23 are chosen, on the basis of the design, dimensioning and mounting of the swivel levers 25, 26, such that each heating plate 22, 23 in the heating position bears fully against the assigned pack side. In the case of a cuboid pack 10, the heating plates 22, 23 in this working position are accordingly directed parallel to each other. For the take-up and release of a pack 10, the heating plates 22, 23 are swiveled into an outwardly diverging opening position. The introduction of the packs 10 in an approximate radial direction is thereby facilitated, similarly the removal of the treated packs, in particular upon transfer to an evacuating conveyor 27. The variously long swivel levers 25, 26 are mounted by means of swivel bearings 40, 41 on the shrinking revolver 19 or on a revolver plate. The swivel bearings 40, 41 are mounted roughly on a common radial plane, the swivel lever 25 being of angular configuration and the shorter swivel lever 26 being of rectilinear configuration.

Figure 9:
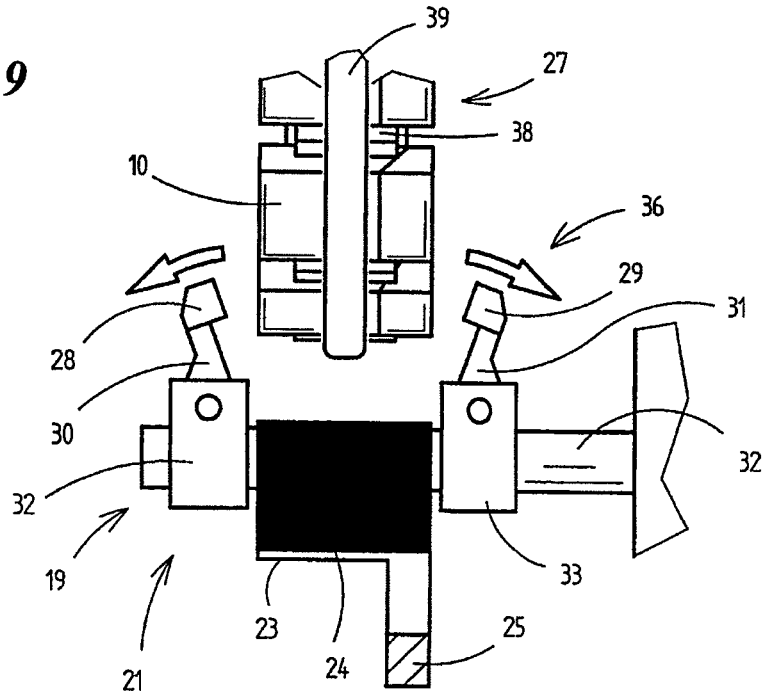
FIG. 9 shows a cross section XI-XI of FIG. 8, pointing in the radial direction.

One peculiarity is the configuration of the receptacle 21 for the handling of the packs 10. To each receptacle 21 there are assigned movable holding members for the packs 10, namely swivelable holding jaws 28, 29. These can be actuated independently of the heating plates 22, 23 and grip the pack 10 on transversely directed pack sides not covered by the heating plates 22, 23, here in the region of the end face 15 and bottom face 16. The holding jaws 28, 29 are accordingly movable in the axis-parallel direction between the holding position (FIG. 4, FIG. 5) and opening position (FIG. 6, FIG. 9).

The holding jaws have a multiple function, serve namely also to accept the packs 10 from the supply conveyor or from the sealing revolver 20, to position the pack 10 in the receptacle 21 and to transfer it to the evacuating conveyor 27. The holding jaws 28, 29 are correspondingly movable. Swivel arms 30, 31 assigned to each holding jaw 28, 29 are—pivotably—attached to a support, which, for its part, is movably mounted on the shrinking revolver 19. The support is here constituted by a rotatable supporting rod 32, on which the two swivel arms 30, 31 are mounted with holding sleeves in an equidirectional relative position. Through rotation of the supporting rod 32, the supporting elements 33 are correspondingly rotated, and with these the holding jaws 28, 29, via the swivel arms 30, 31.

Due to corresponding control of the holding jaws 28, 29, the packs 10 are gripped in the region of the sealing revolver 20 in an upper receiving station 34 and moved by corresponding swivel motion along the outer periphery of the shrinking revolver 19 (outside the same). As the packs 10 are rotated about their longitudinal axis, these are finally introduced from outside into the region of the receptacle 21 and are positioned there on a fixed contact element 35 of the revolver. After this, the heating plates 22, 23 are transported into the treatment position in bearing contact with the front side 11 and rear side 12, the holding jaws 28, 29 remaining in the holding position. Next, these are briefly swiveled back (FIG. 6) to enable the pack 10 to align itself in a tension-free manner to the heating plates 22, 23. The holding jaws 28, 29 then revert to the holding position and remain in this position during the shrinking process.

Figure 7:
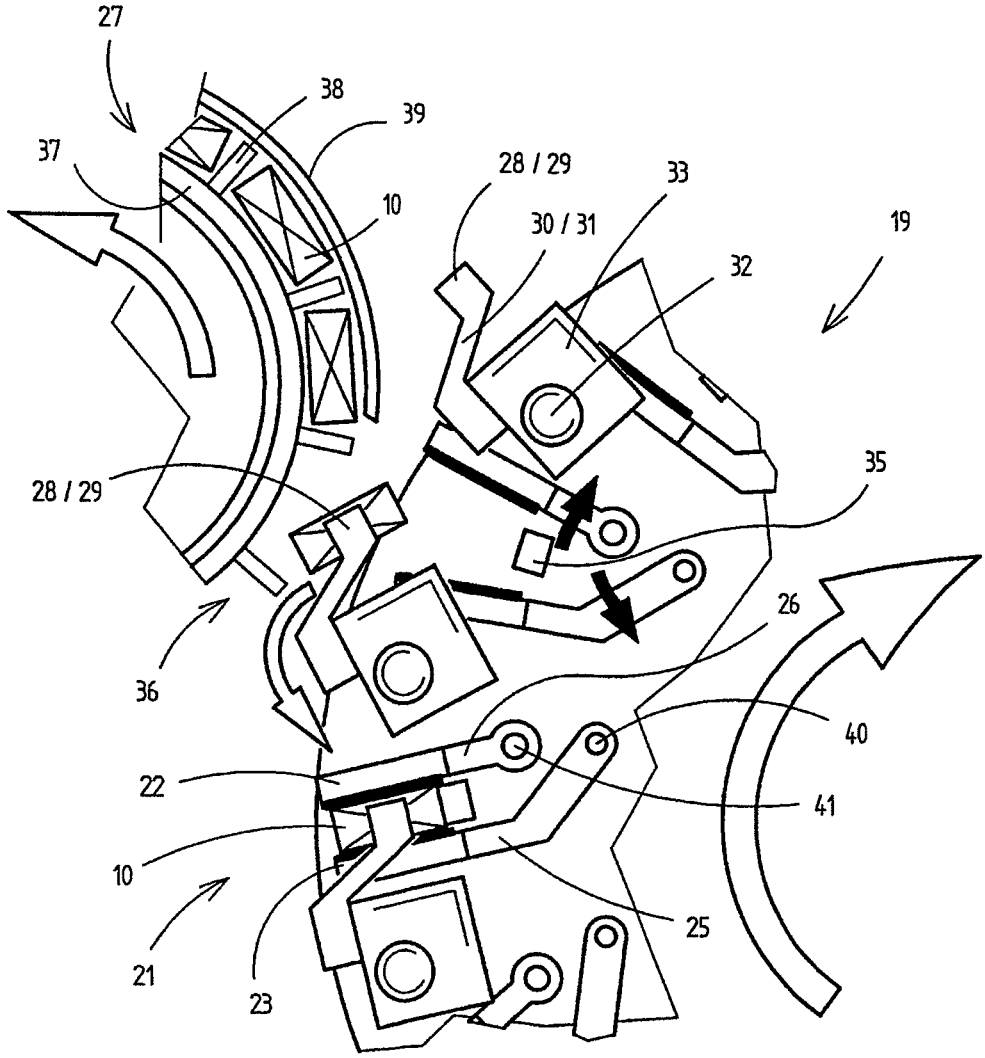
FIG. 7 shows a further detail of the shrinking revolver in the region of transfer of the packs to an evacuating conveyor.
Figure 8:
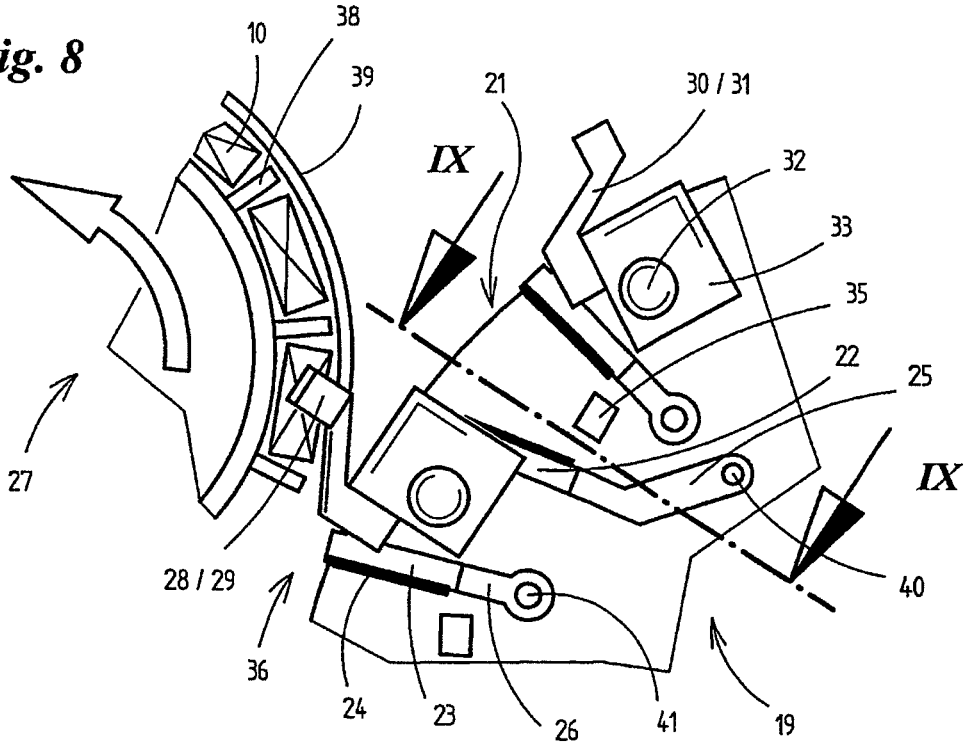
FIG. 8 shows the detail according to FIG. 7, the relative position of movable members having been altered.

During the shrinkage of the film 17, the packs 10 are transported along a part-circle by the shrinking revolver 19, here roughly along half a revolution. In the region of a delivery station 36, the heating plates 22, 23 are transported into the opening position. The holding jaws 28, 29 are actuated in a motion opposite to the reception of a pack. The finished pack 10 is moved in a region outside the shrinking revolver 19 and transferred to the evacuating conveyor 27. This is configured as a belt conveyor, namely having a middle belt 37, which has drivers 38. These are arranged at a distance apart corresponding to the dimensioning of the packs 10, so that the packs 10 are placed into open pockets of the evacuating conveyor 27 (FIG. 7, FIG. 8). The motional characteristics of the holding jaws 28, 29 allow depositing on the belt 37 running at a distance from the shrinking revolver 19. A fixed outer guide 39 secures the packs 10 as they are transported onward by the evacuating conveyor 27.

Figure 10:
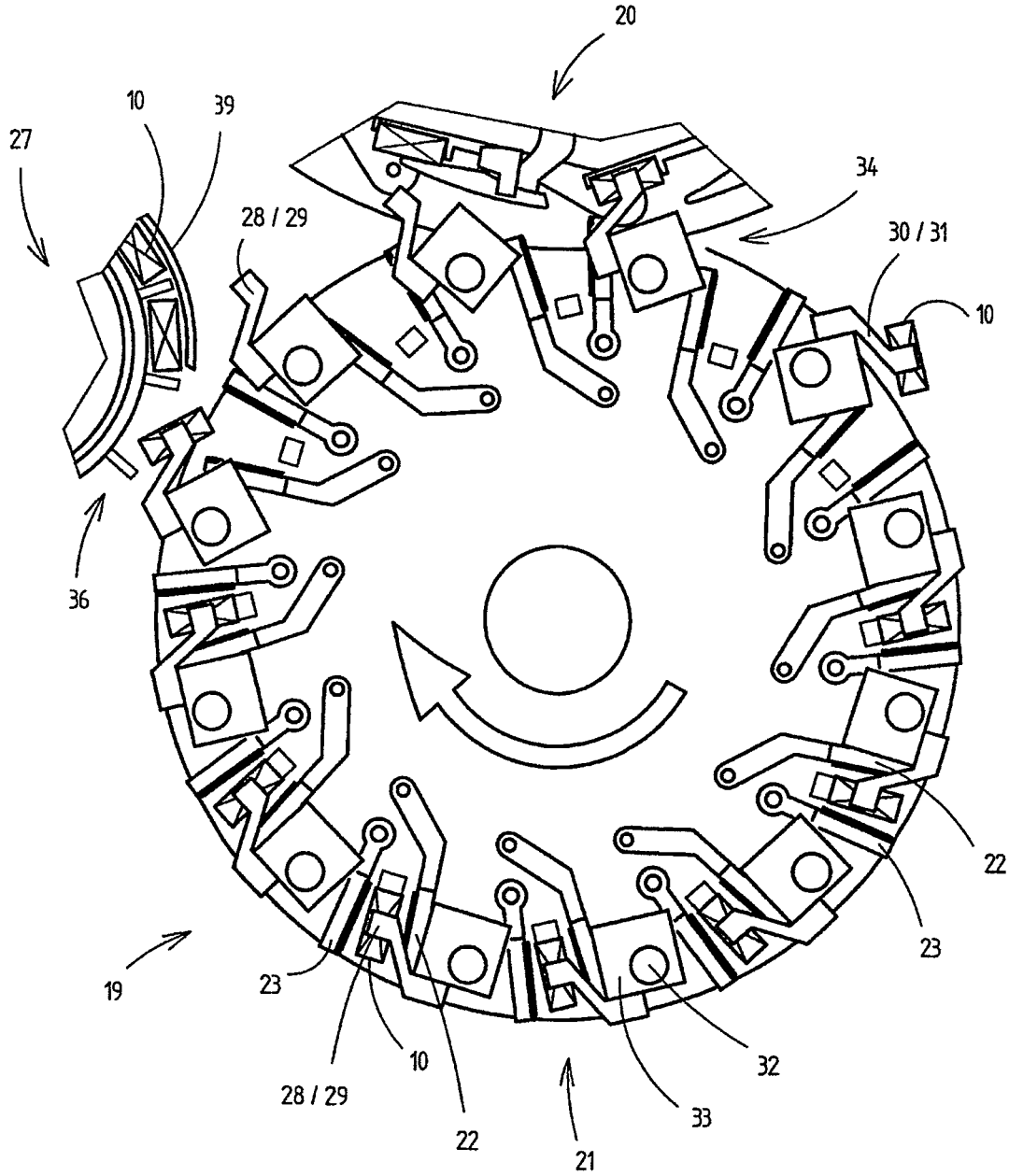
FIG. 10 shows the complete shrinking revolver with supply and evacuating members.

The design of the shrinking revolver 19 allows the shrinking process to be precisely matched to technical requirements. For instance, the temperature of the heating plates 22, 23 can be adjusted, to be precise with a change during the shrinking process. Furthermore, the individual mobility of the heating plates 22, 23 allows them to be raised from the packs 10, insofar as this is possible. FIG. 10 shows an operating state with heating plates 22, 23, in their entirety, raised or swiveled back. This is necessary, for example, when the shrinking revolver 19 has to be halted for operating reasons. Individual packs 10 can also, where necessary, be separated out, by opening of the heating plates 22, 23 and the holding jaws 28, 29 of the receptacle 21 in question.

All elements of the shrinking revolver 19 are disposed on a common, rotary support, namely on a revolver plate.

REFERENCE SYMBOL LIST

10 pack
11 front side
12 rear side
13 side face
14 side face
15 end face
16 bottom face
17 film
19 shrinking revolver
20 sealing revolver
21 receptacle
22 heating plate
23 heating plate
24 heating pad
25 swivel lever
26 swivel lever
27 evacuating conveyor
28 holding jaw
29 holding jaw
30 swivel arm
31 swivel arm
32 supporting rod
33 supporting element
34 receiving station
35 contact element
36 delivery station

37 belt
38 driver
39 outer guide
40 swivel bearing
41 swivel bearing

The invention claimed is:

1. A device for producing cuboid-shaped hard packs (10) for cigarettes having an outer wrapping of shrinkable film (17), the packs (10) having a large-area front side (11) and a corresponding rear side (12), wherein heat is supplied in the region of the front side (11) and the rear side (12) following a sealing station (20) for the thermal sealing of folding tabs of the film (17) in the region of a shrinking unit, wherein:

a) the shrinking unit is configured as a continuously rotating shrinking revolver (19) having receptacles (21) spaced apart from each other along the circumference, for one pack (10) each;

b) each receptacle (21) has at least two heating plates (22, 23) which, during the conveyance of the packs (10) by the shrinking revolver (19), bear against large-area, mutually opposing pack surfaces, namely against front side (11) and rear side (12);

c) the heating plates (22, 23) are movable relative to the packs (10) and, at least in the region of a receiving station (34) for the packs (10) and in the region of a delivery station (36), the heating plates (22, 23) are raised from the packs (10); and d) each pack (10) is fixed in the respective receptacle (21) of the shrinking revolver (19) by movable holding jaws (28, 29) which bear against exposed, mutually opposing pack faces (15, 16) not covered by the heating plates (22, 23) and which are movable independently of the heating plates (22, 23).

2. The device as claimed in claim 1, wherein the heating plates (22, 23) are respectively disposed on a swivel lever (25, 26) and are swivelable by the swivel lever (25, 26) such that the heating plates (22, 23), in the positions raised from the packs (10), assume an outwardly diverging relative position, yet in bearing contact against the packs (10) the heating plates (22, 23) are directed parallel to each other.

3. The device as claimed in claim 1, wherein:

a) the packs (10) are aligned in the receptacles (21) of the shrinking revolver (19) with the longitudinal extent of the packs (10) running axis-parallel to the shrinking revolver (19);

b) the large-area pack sides, namely the front side (11) and the rear side (12), point forward, on one hand, and rearward, on the other hand, in the rotational direction of the shrinking revolver (19);

c) smaller pack faces, namely end face (15) and bottom face (16), are exposed on both sides of the receptacle (21), as seen in the axial direction; and d) the holding jaws (28, 29) come to bear against the end face (15) and the bottom face (16).

4. The device as claimed in claim 1, wherein:

a) each holding jaw (28, 29) of the receptacles (21) is assigned to a swivel arm, b) the holding jaws (28, 29) can be swiveled by movement of the swivel arms (30, 31) until they come to bear on the assigned, mutually opposing pack surfaces (15, 16), c) the holding jaws (28, 29), by appropriate movement of the swivel arms (30, 31), are lifted from pack surfaces (15, 16) in order to accept a pack (10) or to transfer same.

5. The device as claimed in claim 1, wherein each of the receptacles (21) has a radially inner supporting member for the packs (10), namely a fixed stop element (35) for the exact positioning of the pack (10) in the receptacle (21).

6. A device for producing cuboid-shaped hard packs (10) for cigarettes having an outer wrapping of shrinkable film (17), wherein heat is supplied to the packs (10) following a sealing station (20) for the thermal sealing of folding tabs of the film (17) in the region of a shrinking unit, wherein:

a) the shrinking unit is configured as a continuously rotating shrinking revolver (19) having receptacles (21) spaced apart from each other along the circumference, the receptacles being for one pack (10) each;

b) the packs (10) are aligned in the receptacles (21) of the shrinking revolver (19) with the longitudinal extent of the packs (10) running axis-parallel to the shrinking revolver (19);

c) large-area pack sides, namely front side (11) and rear side (12), are directed essentially radially to the shrinking revolver (19) and point forward, on one hand, and rearward, on the other, in the rotational direction of the shrinking revolver (19);

d) smaller pack faces, namely end face (15) and bottom face (16), are exposed on opposite sides of the shrinking revolver (19) as seen in the axial direction;

e) each of the receptacles (12) has at least two heating plates (22, 23) which, during the conveyance of the packs (10) by the shrinking revolver (19), bear against mutually opposite sides of the pack (10), namely the front side (11) and the rear side (12);

f) the heating plates (22, 23) are movable relative to the packs (10) and, at least in the region of a receiving station (34) for the packs (10) and in the region of a delivery station (36), the heating plates (22, 23) are raised from the packs (10);

g) the packs (10) are fixed in the receptacles (21) of the shrinking revolver (19) by movable holding jaws (28, 29) which come to bear against the end face (15) and the bottom face (16) of the packs (10); and h) the holding jaws (28, 29) are movable independently of the heating plates (22, 23) for fixing and releasing the packs (10).

7. The device as claimed in claim 6 wherein:

a) the holding jaws (28, 29) are movable together in a transverse-axial direction relative to the shrinking revolver (19);

b) the swivel arms (30, 31) of the holding jaws (28, 29) are mounted on a common, movable supporting member, namely on a rotatable supporting rod (32); and c) the supporting rod (32), which is rotatable about the longitudinal axis in a reciprocating manner, is rotatable axis-parallel to the shrinking revolver (19) in such a way that the holding jaws (28, 29), by appropriate rotation of the supporting rod (32), are movable out of a peripheral region of the shrinking revolver (19) in order to accept a pack (10) from a supply conveyor or to transfer packs (10), subsequent to the shrinking process, to an evacuating conveyor (27).

8. The device as claimed in claim 7, wherein:

a) the packs (10) are gripped by the movable holding jaws (28, 29) are deposited into the receptacle (21);

b) once a pack (10) has been deposited into the receptacle (21), the heating plates (22, 23) are moved into bearing contact against the front side (11) and the rear side (12) of the pack (10); and c) after the heating plates (22, 23) have been brought to bear against the surfaces (11, 12) of the pack (10), the holding jaws (28, 29) are lifted briefly from the surfaces (15, 16) of the pack and are thereafter moved back into the contact position on the surfaces of the pack (10).

9. The device as claimed in claim 6, wherein each of the receptacles (21) has a radially inner supporting member for the packs (10), namely a fixed stop element (35) for the exact positioning of the pack (10) in the receptacle (21).

* * * * *